US008985005B1

(12) United States Patent
Dubois et al.

(10) Patent No.: US 8,985,005 B1
(45) Date of Patent: Mar. 24, 2015

(54) REPEATING FIREARM

(71) Applicant: Smith & Wesson Corp., Springfield, MA (US)

(72) Inventors: Jason Dubois, North Smithfield, RI (US); David S. Findlay, Athol, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/134,130

(22) Filed: Dec. 19, 2013

(51) Int. Cl.
*F41C 27/00* (2006.01)
*F41A 19/06* (2006.01)

(52) U.S. Cl.
CPC ..... *F41A 19/06* (2013.01)
USPC ..... 89/128; 89/138

(58) Field of Classification Search
CPC ..... F41A 19/33; F41A 19/30; F41A 15/12; F41A 17/46; F41A 19/45; F41A 17/74; F41A 3/68
USPC ..... 89/128, 138
See application file for complete search history.

(56) References Cited

U.S. PATENT DOCUMENTS

| | | | | |
|---|---|---|---|---|
| 924,169 | A | 12/1908 | Mauser | |
| 952,896 | A | 3/1910 | Frommer | |
| 954,654 | A | 4/1910 | Smith | |
| 1,331,154 | A * | 2/1920 | Johnson | 42/16 |
| 1,430,662 | A * | 10/1922 | Lewis | 89/185 |
| 1,473,571 | A * | 11/1923 | Pedersen | 89/145 |
| 2,659,994 | A * | 11/1953 | Yale | 42/69.02 |
| 3,292,492 | A * | 12/1966 | Sturtevant | 89/128 |
| 3,680,241 | A * | 8/1972 | Ramsay | 42/10 |
| 3,736,839 | A | 6/1973 | Childers | |
| 3,972,142 | A * | 8/1976 | Kawamura | 42/69.01 |
| 4,020,740 | A | 5/1977 | Schirneker | |
| 4,128,042 | A * | 12/1978 | Atchisson | 89/138 |
| 4,265,161 | A | 5/1981 | Beretta | |
| 4,671,005 | A * | 6/1987 | Jewell | 42/69.02 |
| 4,914,845 | A | 4/1990 | Reese et al. | |
| 5,223,649 | A | 6/1993 | Claridge | |
| 5,228,887 | A | 7/1993 | Mayer | |
| 5,272,956 | A | 12/1993 | Hudson | |
| 5,659,992 | A | 8/1997 | Mistretta | |
| 5,673,505 | A | 10/1997 | Phillips | |
| 5,682,699 | A | 11/1997 | Gentry | |

(Continued)

FOREIGN PATENT DOCUMENTS

| | | |
|---|---|---|
| DE | 2357379 A1 | 5/1975 |
| EP | 174901 A2 | 3/1986 |

(Continued)

*Primary Examiner* — Samir Abdosh
(74) *Attorney, Agent, or Firm* — John A. Chionchio; Ballard Spahr LLP

(57) ABSTRACT

A mechanism for a repeating firearm has a body pivotably mounted within the receiver and movable between a first position where it blocks motion of the bolt carrier, and a second position where it engages either the trigger or the hammer to prevent discharge. In operation the body is moved from the first position to the second to release the bolt carrier, which moves into battery. The body is then allowed to move out of the second position toward the first position. The rife may be discharged by a pull of the trigger, and the bolt carrier moves out of battery and is arrested by the body before moving back to battery. If the body is maintained in the second position during operation its engagement with the trigger or hammer prevents discharge of the firearm.

25 Claims, 8 Drawing Sheets

(56) References Cited

U.S. PATENT DOCUMENTS

| | | | | |
|---|---|---|---|---|
| 5,799,434 | A | 9/1998 | Krieger | |
| 5,913,261 | A * | 6/1999 | Guhring et al. | 89/128 |
| 6,212,814 | B1 * | 4/2001 | Lambie | 42/75.03 |
| 6,293,040 | B1 | 9/2001 | Luth | |
| 6,367,188 | B1 | 4/2002 | Vargas | |
| 6,418,655 | B1 | 7/2002 | Kay | |
| 6,760,991 | B1 | 7/2004 | Gentry | |
| 6,851,346 | B1 | 2/2005 | Herring | |
| 7,574,951 | B2 | 8/2009 | Calvete | |
| 7,934,446 | B2 | 5/2011 | Engel et al. | |
| 8,112,928 | B2 | 2/2012 | Keough | |
| 2010/0236394 | A1 * | 9/2010 | Gomez | 89/138 |
| 2011/0283580 | A1 * | 11/2011 | Esch | 42/14 |
| 2011/0315002 | A1 | 12/2011 | Keough | |
| 2012/0023800 | A1 | 2/2012 | Laney | |
| 2014/0311004 | A1 | 10/2014 | Barrett | |

FOREIGN PATENT DOCUMENTS

| | | | |
|---|---|---|---|
| EP | 2053336 | B1 | 8/2010 |
| FR | 2759450 | A1 | 8/1998 |

* cited by examiner

FIG. 3
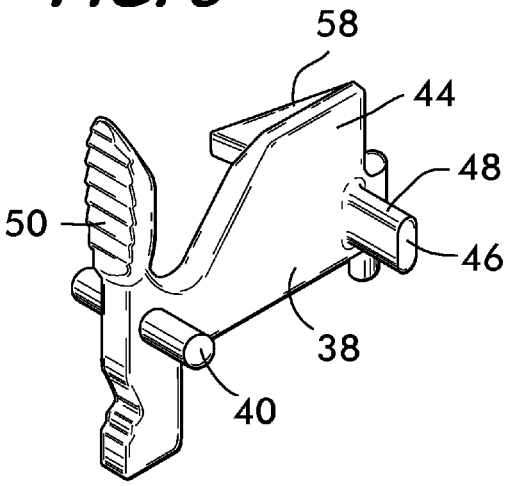
FIG. 4
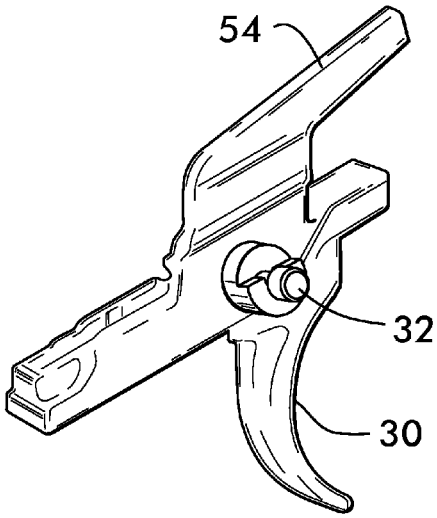
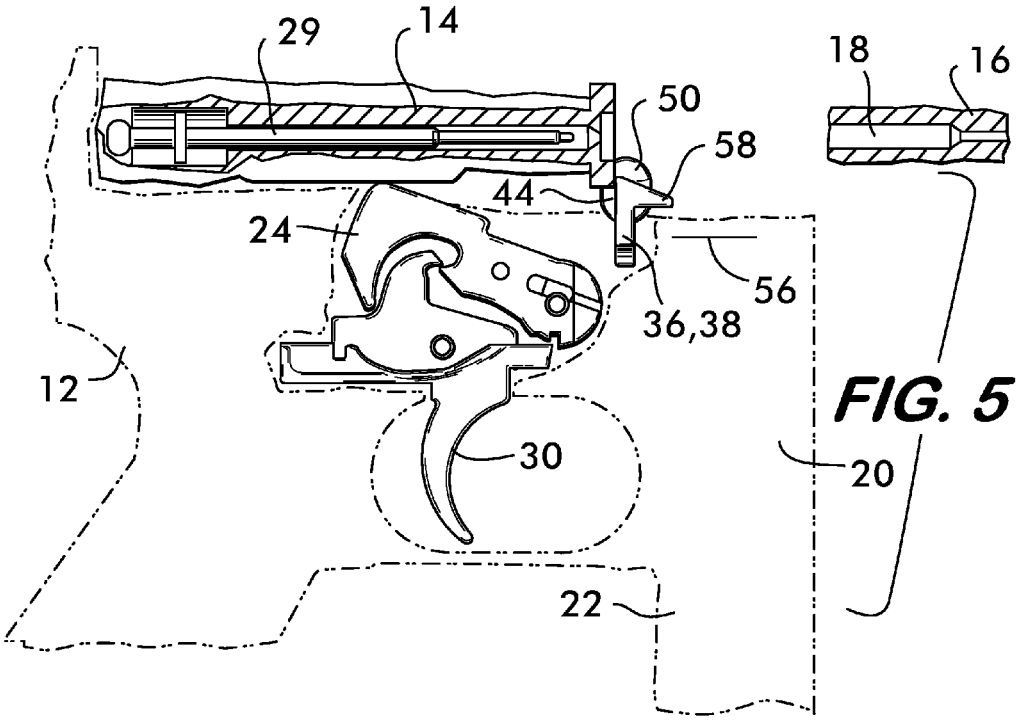
FIG. 5

REPEATING FIREARM

FIELD OF THE INVENTION

This invention concerns repeating firearms, such as magazine fed repeating rifles.

BACKGROUND

Modern sporting rifles may operate in a mode in which a single pull of the trigger discharges a round, and a portion of the energy of the discharging round is harnessed (via recoil, blowback or gas operation) to extract and eject the spent cartridge, cock the hammer, strip a live round from the ammunition magazine and chamber the live round, ready to be discharged by another pull of the trigger.

Repeating firearms, for example, repeating rifles, are also of interest to modern shooters. In a repeating firearm, the shooter must take action to complete the loading cycle.

SUMMARY

The invention concerns a mechanism positionable in a receiver of a firearm, such as a rifle, for holding a bolt carrier in an open position. The firearm comprises a hammer movably mounted substantially within the receiver and a trigger movably mounted substantially within the receiver. In an example embodiment, the mechanism comprises a body movably mountable substantially within the receiver. The body has a first and a second surface thereon. The body is movable between a first position, wherein the first surface engages and holds the bolt carrier in the open position, and a second position, wherein the first surface does not engage the bolt carrier. The second surface is engageable with one of the trigger or the hammer when the body is in the second position so as to prevent a discharge of the firearm, unless the body has been manipulated by the shooter. In this example embodiment, a spring acts between the receiver and the body for biasing the body into the first position.

By way of example, the mechanism may further comprise a pin mountable on the receiver. The body is mountable on the pin for pivoting movement between the first and the second positions. A tab may be attached to the body in spaced relation to the pin for manually moving the body between the first and the second positions.

In a particular example embodiment, a boss is positioned on the body and projects transversely therefrom. The second surface is positioned on the boss. By way of further example, a finger projects from the trigger. The finger engages the second surface on the boss when the body is in the second position and thereby prevents motion of the trigger.

In another example embodiment, a notch is positioned in the hammer. The notch is aligned with the boss when the body is not in the second position and thereby permits motion of the hammer to discharge the firearm. The notch is out of alignment with the boss when the body is in the second position. The hammer thereby is engageable with the second surface of the boss to prevent discharge of the firearm.

The invention also encompasses a repeating firearm, such as a repeating rifle. In one example embodiment, the repeating firearm comprises a receiver. A barrel is mounted on the receiver. A bolt carrier is mounted on the receiver and is movable between an open position and a closed position wherein the bolt carrier engages a chamber of the barrel. A hammer is movably mounted substantially within the receiver. A trigger is movably mounted substantially within the receiver. A body is movably mounted substantially within the receiver. The body has a first and a second surface thereon. The body is movable between a first position wherein the first surface engages and holds the bolt carrier in the open position, and a second position wherein the first surface does not engage the bolt carrier. The second surface is engageable with the trigger when the body is in the second position so as to prevent motion of the trigger and thereby a discharge of the firearm. In this example embodiment, a spring acts between the receiver and the body for biasing the body into the first position.

In a particular example embodiment, a pin is mounted on the receiver. The body is mounted on the pin for pivoting movement between the first and the second positions. The pin is mounted on an outside surface of the receiver in one example embodiment. By way of example, a tab is attached to the body in spaced relation to the pin. The tab extends outside of the receiver for manually moving the body between the first and the second positions.

By way of example, a boss is positioned on the body and projects transversely therefrom. The second surface is positioned on the boss. In another example, a finger projects from the trigger. The finger engages the second surface on the boss when the body is in the second position and thereby prevents motion of the trigger.

In another example embodiment, a notch is positioned in the hammer. The notch is aligned with the boss when the body is not in the second position and thereby permits motion of the hammer to discharge the firearm. The notch is out of alignment with the boss when the body is in the second position. The hammer thereby is engageable with the second surface of the boss to prevent discharge of the firearm.

By way of example, the firearm may further comprise a magazine well positioned within the receiver. An ammunition magazine is removably positionable within the magazine well.

The invention further comprises a repeating firearm, such as a repeating rifle. In a particular example embodiment, the firearm comprises a receiver. A barrel is mounted on the receiver. A bolt carrier is mounted on the receiver and is movable between an open position and a closed position wherein the bolt carrier engages a chamber of the barrel. A hammer is movably mounted substantially within the receiver. A trigger is movably mounted substantially within the receiver. A body is movably mounted substantially within the receiver. The body has a first and a second surface thereon. The body is movable between a first position, wherein the first surface engages and holds the bolt carrier in the open position, and a second position, wherein the first surface does not engage the bolt carrier. The second surface is engageable with the hammer when the body is in the second position so as to inhibit motion of the hammer and thereby prevent a discharge of the firearm. A spring acts between the receiver and the body for biasing the body into the first position.

By way of example, a pin is mounted on the receiver. The body is mounted on the pin for pivoting movement between the first and the second positions. In a particular example embodiment, the pin is mounted on an outside surface of the receiver. By way of example, a tab is attached to the body in spaced relation to the pin. The tab extends outside of the receiver for manually moving the body between the first and the second positions.

In a further example, the body comprises a boss positioned on the body. The boss projects transversely therefrom. In this example the second surface is positioned on the boss.

In an example embodiment, the firearm further comprises a notch positioned in the hammer. The notch is aligned with the boss when the body is not in the second position and thereby permits motion of the hammer to discharge the firearm. The notch is out of alignment with the boss when the body is in the second position. The hammer thereby is engageable with the second surface of the boss to prevent discharge of the firearm.

In another example embodiment, the firearm further comprises a magazine well positioned within the receiver. An ammunition magazine is removably positionable within the magazine well.

BRIEF DESCRIPTION OF THE DRAWINGS

FIG. 3 is an isometric view of an example mechanism embodiment according to the invention;

FIG. 4 is an isometric view of an example trigger used with the mechanism of FIG. 3;

FIG. 5 is a partial longitudinal sectional view of the firearm shown in FIG. 1 having the example mechanism shown in FIG. 3;

DETAILED DESCRIPTION

Figure 1:
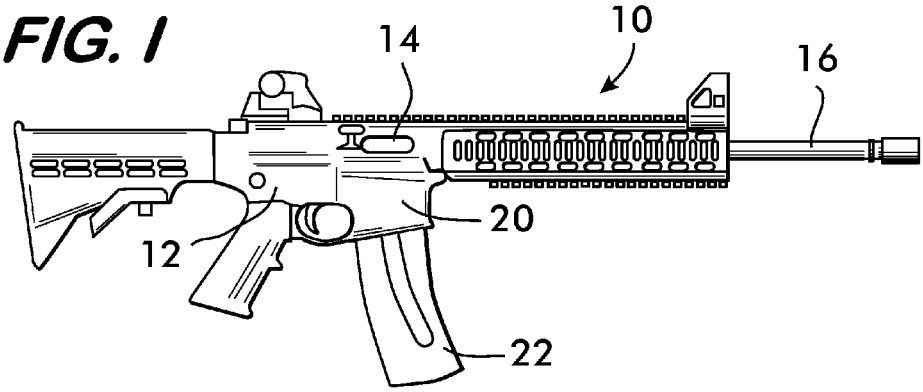
FIG. 1 is a right side view of a repeating firearm according to the invention.

FIG. 1 shows an example firearm according to the invention in the form of a repeating rifle 10. Rifle 10 comprises a receiver 12, a bolt carrier 14 mounted on the receiver, and a barrel 16 also mounted on the receiver. Barrel 16 has a chamber 18 (shown in FIG. 5) that is engaged by the bolt carrier 14 when it is in the closed position (shown in FIG. 1), the bolt carrier 14 being movable relatively to the receiver between the closed position and an open position (shown in FIG. 5). Rifle 10 further includes a magazine well 20 that receives an ammunition magazine 22.

Figure 2:
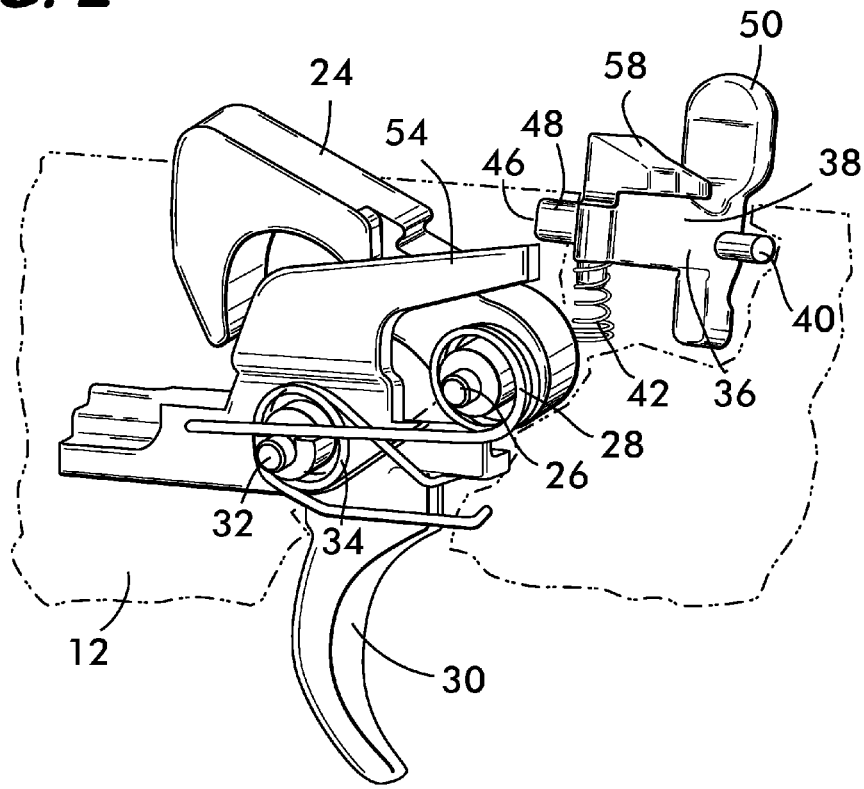
FIG. 2 is a partial isometric view of the receiver of the firearm shown in FIG. 1 with an example embodiment of the mechanism according to the invention.

As shown in FIG. 2, a hammer 24 is mounted substantially within the receiver 12 and is pivotable on a pin 26. Hammer 24 is biased in a clockwise direction (when viewed from the right side of the rifle) by a spring 28 to fall upon a firing pin 29 in the bolt carrier 14 (see FIG. 5) when released by a pull of the trigger 30. As shown in FIG. 2, trigger 30 is mounted substantially within receiver 12 and pivots on a pin 32. Trigger 30 is biased in a counterclockwise direction by a spring 34.

FIG. 2 shows one example embodiment of a mechanism 36 for holding the bolt carrier 14 in an open position. In this embodiment, mechanism 36 comprises a body 38 movably mounted substantially within the receiver 12. Body 38 pivots on a pin 40 between a first position (shown), where it is engageable with the bolt carrier 14 (see FIG. 5) and a second position (see FIG. 7), where it is not engageable with the bolt carrier. As explained further below, when body 38 is in the second position it prevents discharge of the rifle. With reference again to FIG. 2, a spring 42 acts between the receiver 12 and the body 38 to bias the body toward the first position where it is engageable with the bolt carrier. In this particular example, the spring 42 is a coil spring positioned distally to the pivot pin 40, but other spring biasing configurations are of course feasible.

Figure 5A:
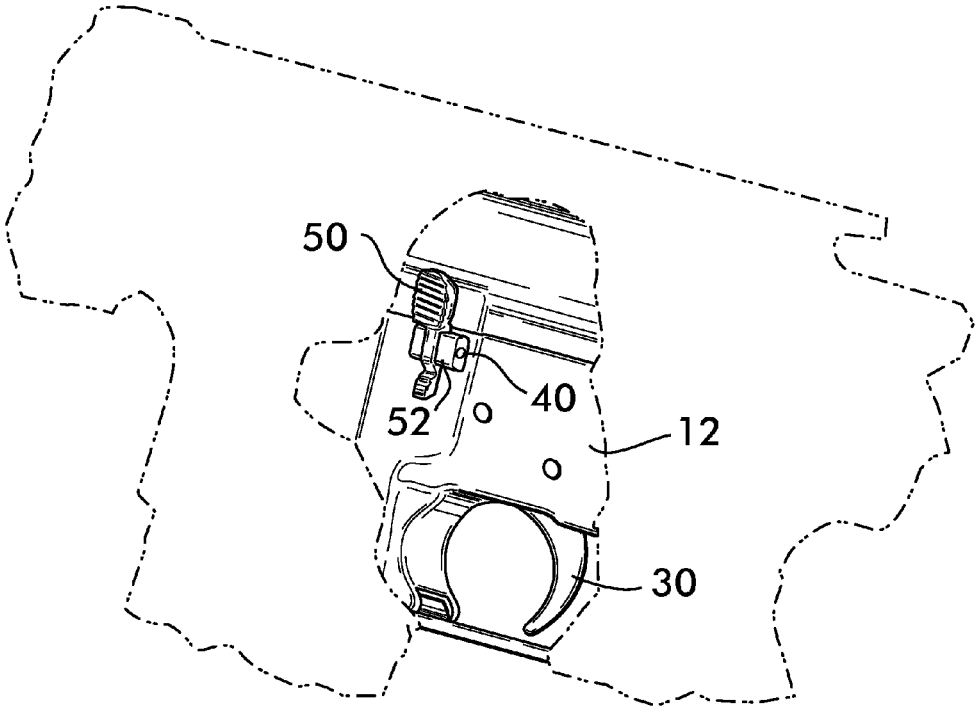
FIG. 5A is a left side view of the firearm shown in FIG. 1.
Figure 7:
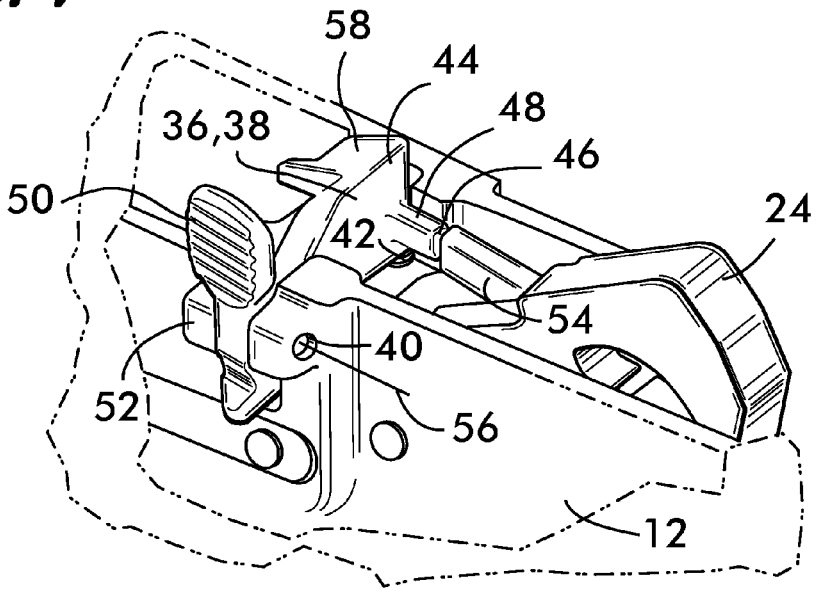

FIG. 3 shows body 38 in detail as comprising a first surface 44 that is engageable with the bolt carrier 14 (see FIG. 5) when the body 38 is in the first position, and a second surface 46 that engages trigger 30 when the body 38 is in the second position (see FIG. 7). The trigger engaging surface 46 is positioned on a boss 48 that projects transversely from the body 38. A tab 50 is attached to body 38 in spaced relation to pin 40. As shown in FIG. 5A, the tab 50 extends to the outside of the receiver 12 to permit manual actuation of body 38 between the first and second positions. Pin 40 is mounted on the outside of receiver 12 on lugs 52.

FIG. 4 shows trigger 30 in detail. In mechanism example 36, trigger 30 includes a finger 54 that projects from the trigger and is offset from the trigger pin 32. When trigger 30 is pulled and pivots about its pin 32, the finger 54 moves toward the body 38 due to its offset from the pin 32. As described below, finger 54 will engage the second surface 46 on boss 48 of body 38 when the body is in the second position, i.e., the position where the first surface 44 of body 38 is not engageable with the bolt carrier 14.

Operation of the rifle 10 and mechanism 36 are now described with reference to FIGS. 5-7. FIG. 5 shows a portion of the receiver 12, barrel 16, and chamber 18 of rifle 10 with the bolt carrier 14 held in the open position by body 38. Body 38 is in the first position wherein the first surface 44 engages and blocks motion of the bolt carrier toward chamber 18 under the biasing force of a return spring (not shown). Rifle 10 may be fired by first manually depressing tab 50. This pivots body 38 about an axis 56 coaxial with pin 40, moving the body 38 into the second position (see FIG. 7) and thereby releasing the bolt carrier 14, the first surface 44 no longer engaging the bolt carrier. Biased by its return spring (not shown), bolt carrier 14 moves toward chamber 18, strips a round from magazine 22 received in magazine well 20, and chambers the round in chamber 18.

Figure 6:
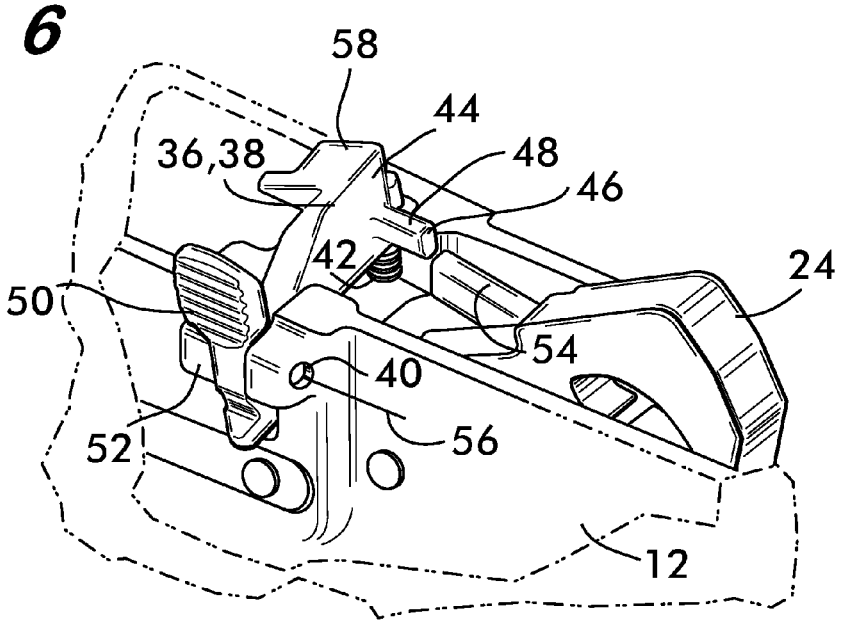
FIGS. 6 and 7 are partial isometric views of the receiver and mechanism of FIG. 3 and the trigger of FIG. 4.

If tab 50 is then released, the body 38 pivots out of the second position under the force of biasing spring 42 into engagement with the bottom of the bolt carrier 14 and near the first position as shown in FIG. 6. When body 38 is in this position the boss 48 is out of alignment with the finger 54 extending from trigger 30. Finger 54 of trigger 30 thus will not engage the second surface 46 when the trigger is pulled, and pulling trigger 30 will discharge the rifle. As the round is discharged, the bolt carrier 14 is driven back away from the chamber 18 against its return spring (for example by recoil, blow-back or gas operation). The spent cartridge is extracted from the chamber and ejected. The bolt carrier 14 passes over the body 38 as it travels away from the chamber 18. Body 38 then pivots fully back to the first position under the force of its biasing spring 42 when the bolt carrier 14 clears the body. When the bolt carrier reaches the end of its travel its return spring forces it forward toward the chamber 18. However, its motion is arrested by the body 38, the first surface 44 again engaging the bolt carrier 14 as depicted in FIG. 5. The next round may be loaded by depressing the tab 50 to release the bolt carrier and chamber another round. The round may be fired by releasing tab 50 and pulling trigger 30.

However, if the tab 50 is not released, but is continuously depressed after the bolt carrier is released, then the body 38 is maintained in the second position shown in FIG. 7. With body 38 in the second position, boss 48 aligns with finger 54. When the trigger 30 is pulled, engagement between the finger 54 and the second surface 46 on boss 48 prevents rotation of the trigger about trigger pin 32, thereby preventing discharge of the rifle. As shown in FIG. 6, release of the tab 50 permits the body 38 to pivot out of the second position back near the first position, moving boss 48 out of alignment with finger 54 of trigger 30 and permitting the trigger to be pulled to discharge the next round.

Figure 8:
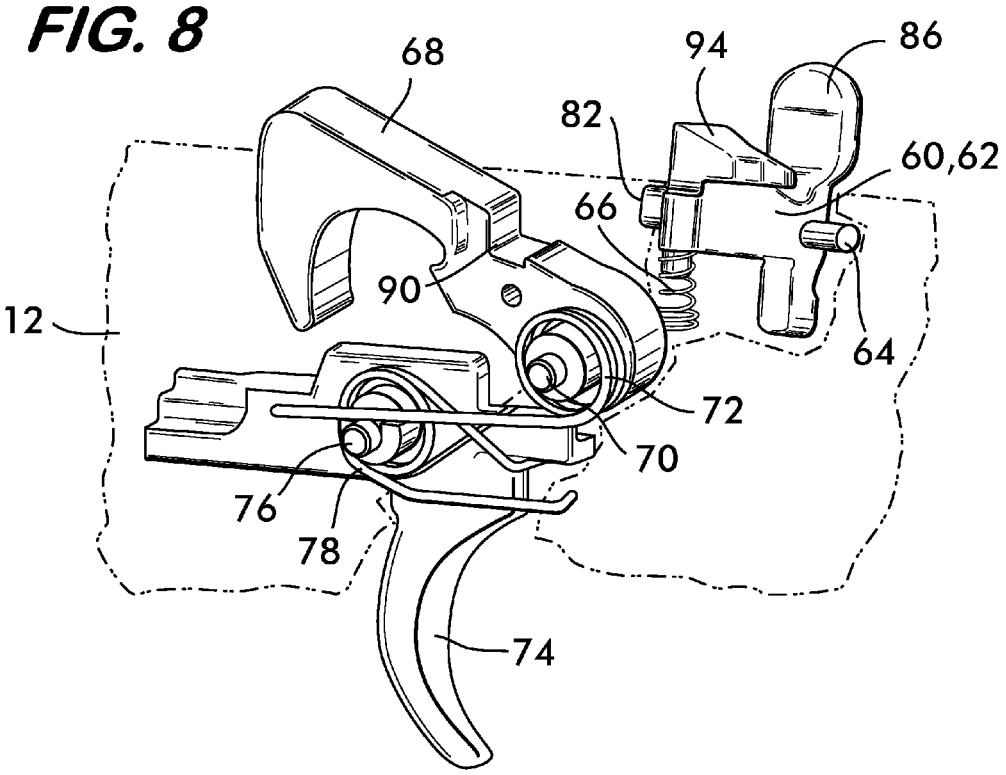
FIG. 8 is a partial isometric view of the receiver of the firearm shown in FIG. 1 with another example embodiment of the mechanism according to the invention.

FIG. 8 shows another example mechanism embodiment 60 for holding the bolt carrier in an open position. Mechanism 60 comprises a body 62 movably mounted substantially within the receiver 12. Body 62 pivots on a pin 64 between a first position (shown, see also FIG. 11), where it is engageable with the bolt carrier 14, and a second position, where it is not engageable with the bolt carrier (see FIG. 13). As explained further below, when body 62 is in the second position it prevents discharge of the rifle. A spring 66 acts between the receiver 12 and the body 62 to bias the body toward the first position where it is engageable with the bolt carrier. In this particular example, the spring 66 is a coil spring positioned distally to the pivot pin 64, but other spring biasing configurations are of course feasible.

As shown in FIG. 8, a hammer 68 is mounted substantially within the receiver 12 and is pivotable on a pin 70. Hammer 68 is biased in a clockwise direction (when viewed from the right side of the rifle) by a spring 72 to fall upon a firing pin 29 (see FIG. 11) when released by a pull of the trigger 74. Trigger 74 is mounted substantially within receiver 12 and pivots on a pin 76. Trigger 74 is biased in a counterclockwise direction by a spring 78.

Figure 9:
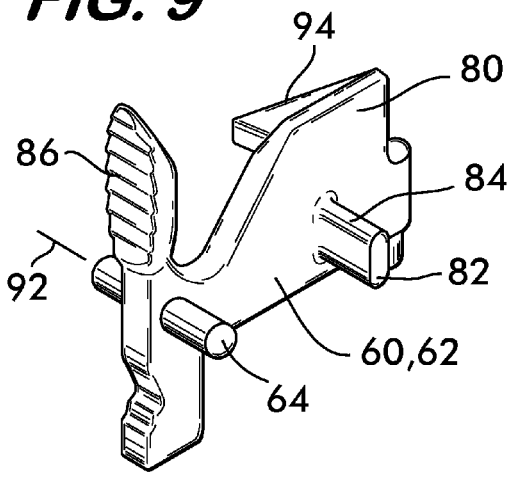
FIG. 9 is an isometric view of another example mechanism embodiment according to the invention.
Figure 13:
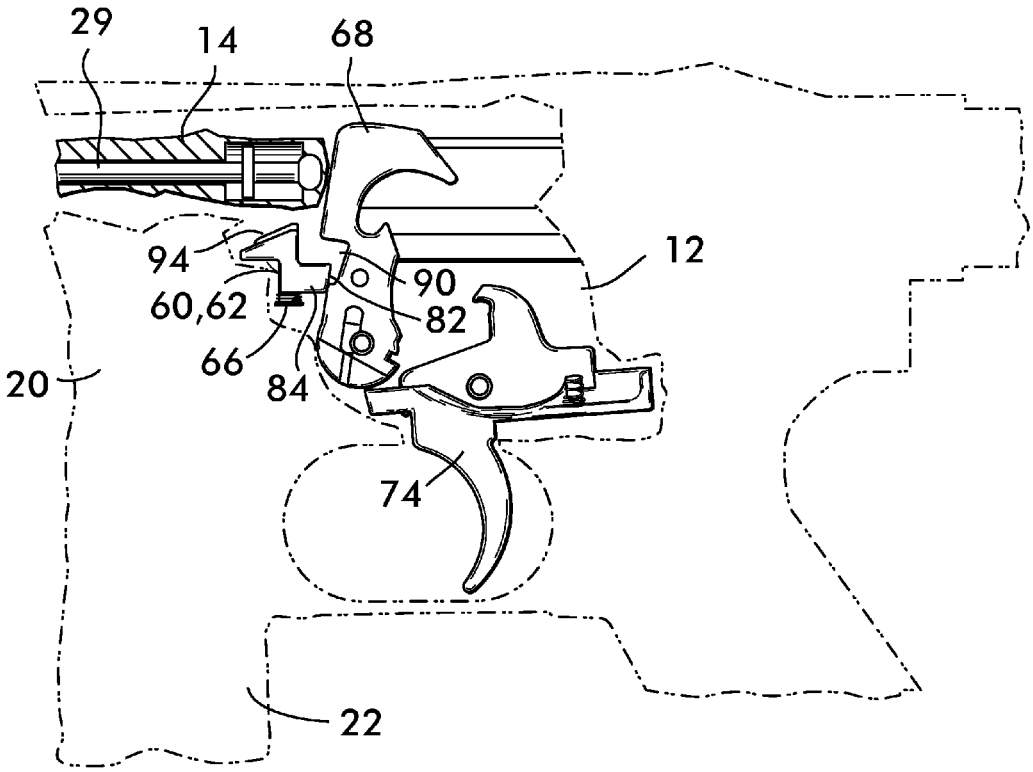

FIG. 9 shows body 62 in detail as comprising a first surface 80 that is engageable with the bolt carrier (see FIG. 11) when the body 62 is in the first position, and a second surface 82 that engages hammer 68 when the body 62 is in the second position (see FIG. 13). The hammer engaging surface 82 is positioned on a boss 84 that projects transversely from the body 62. A tab 86 is attached to body 62 in spaced relation to pin 64. Analogous to tab 50 in FIG. 5A, the tab 86 extends to the outside of the receiver 12 to permit manual actuation of body 62 between the first and second positions. Pin 64 is mounted on the outside of receiver 12 on lugs 52.

Figure 10:
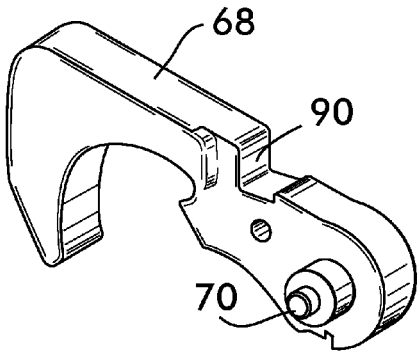
FIG. 10 is an isometric view of an example hammer used with the mechanism of FIG. 9.

FIG. 10 shows hammer 68 in detail. In mechanism example 60, hammer 68 includes a notch 90. When trigger 74 is pulled and pivots about its pin 76, the hammer 68 is released and pivots about its pivot pin 70 under the force of its biasing spring 72. As described below, hammer 68 will engage the second surface 82 on boss 84 of body 62 when the body is in the second position, i.e., the position where the first surface 80 of body 62 is not engageable with the bolt carrier 14.

Figure 11:
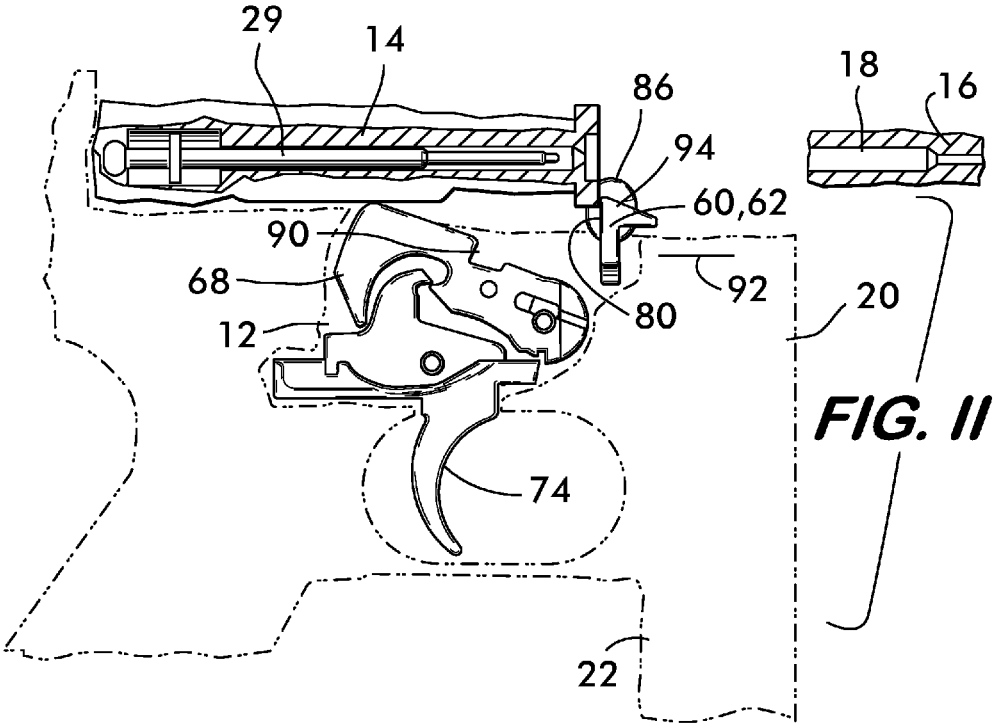
FIG. 11 is a partial longitudinal sectional view of the firearm shown in FIG. 1 having the example mechanism shown in FIG. 9 and the hammer shown in FIG. 10.

Operation of the rifle 10 and mechanism 60 are now described with reference to FIGS. 11-13. FIG. 11 shows a portion of the receiver 12, barrel 16, and chamber 18 of rifle 10 with the bolt carrier 14 held in the open position by body 62. Body 62 is in the first position wherein the first surface 80 engages and blocks motion of the bolt carrier toward chamber 18 under the biasing force of a return spring (not shown). Rifle 10 may be fired by first manually depressing tab 86. This pivots body 62 about an axis 92 coaxial with pin 64, moving the body 62 into the second position (see FIG. 13) and thereby releasing the bolt carrier 14, the first surface 80 no longer engaging the bolt carrier. Biased by its return spring (not shown), bolt carrier 14 moves toward chamber 18, strips a round from magazine 22 received in magazine well 20, and chambers the round in chamber 18.

Figure 12:
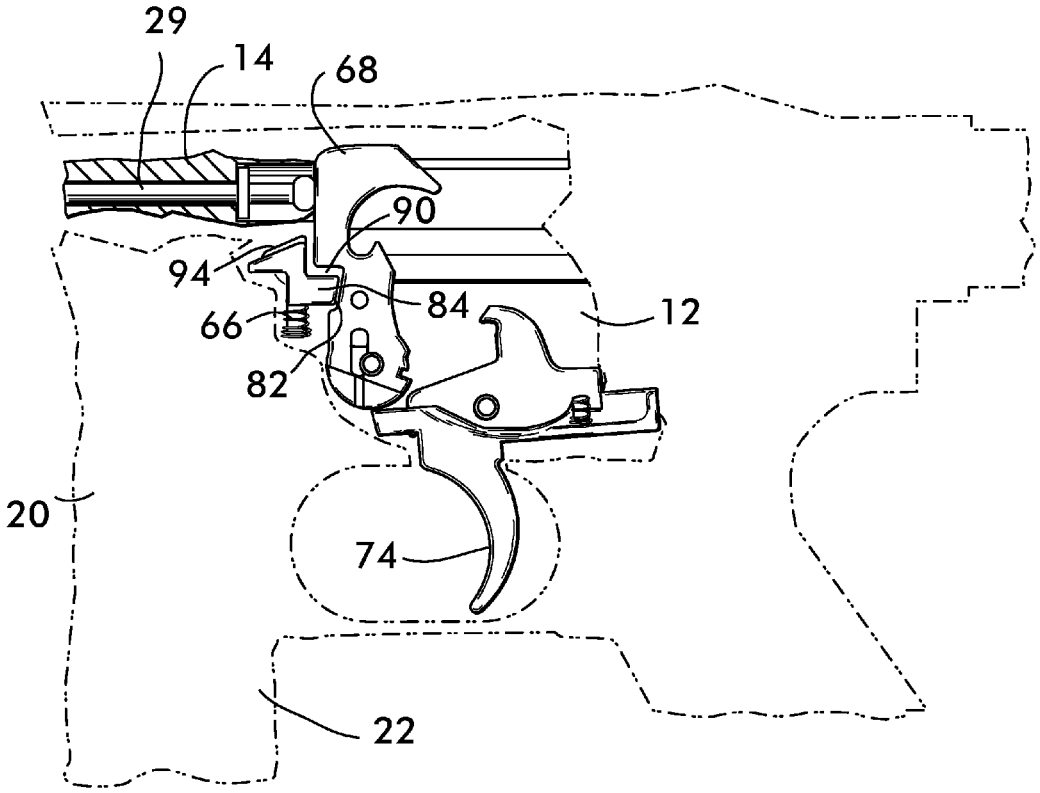
FIGS. 12 and 13 are partial longitudinal sectional views of the receiver, mechanism of FIG. 9 and hammer of FIG. 10.

If tab 86 is then released, the body 62 pivots out of the second position under the force of biasing spring 66 and into engagement with the bottom of the bolt carrier 14 and near the first position as shown in FIG. 12. When body 62 is in this position (i.e., not in the second position) the boss 84 is aligned with the notch 90 in hammer 68. Hammer 68 thus will not engage the second surface 82 when the trigger 74 is pulled, and pulling trigger will discharge the rifle. As the round is discharged, the bolt carrier 14 is driven back away from the chamber against its return spring (for example by recoil, blow-back or gas operation). The spent cartridge is extracted from the chamber and ejected. The bolt carrier passes over the body 62 as it travels away from the chamber 18. Body 62 then pivots back to the first position under the force of its biasing spring 66 when the bolt carrier 14 clears the body. When the bolt carrier reaches the end of its travel, its return spring forces it forward toward the chamber 18. However, its motion is arrested by the body 62, the first surface 80 again engaging the bolt carrier 14 (FIG. 11). The next round may be loaded by depressing the tab 86 to release the bolt carrier and chamber another round. The round may be fired by releasing the tab 86 and pulling the trigger 74.

However, if the tab 86 is not released, but is continuously depressed after the bolt carrier is released, then the body 62 is maintained in the second position. With body 62 in the second position, as shown in FIG. 13, boss 84 is out of alignment with notch 90 of hammer 68. When the trigger 74 is pulled, engagement between the hammer 68 and the second surface 82 on boss 84 prevents the hammer from falling on the firing pin 29, thereby preventing discharge of the rifle. As shown in FIG. 12, release of the tab 86 permits the body 62 to pivot back toward the first position (i.e., out of the second position), moving boss 84 into alignment with notch 90 of hammer 68 and permitting the hammer to fall onto the firing pin 29 and discharge the rifle when trigger 74 pulled.

What is claimed is:

1. A mechanism positionable in a receiver of a firearm for holding a bolt carrier in an open position, said firearm having a hammer movably mounted substantially within said receiver and a trigger movably mounted substantially within said receiver, said mechanism comprising:

a body movably mountable substantially within said receiver, said body having a first and a second surface thereon, said body being movable between a first position wherein said first surface engages and holds said bolt carrier in said open position, and a second position wherein said first surface does not engage said bolt carrier, said second surface being engageable with one of said trigger or said hammer when said body is in said second position so as to prevent a discharge of said firearm; and a spring acting between said receiver and said body for biasing said body into said first position.

2. The mechanism according to claim 1, further comprising a pin mountable on said receiver, said body being mountable on said pin for pivoting movement between said first and said second positions.

3. The mechanism according to claim 2, further comprising a tab attached to said body in spaced relation to said pin for manually moving said body between said first and said second positions.

4. The mechanism according to claim 1, further comprising a boss positioned on said body and projecting transversely therefrom, said second surface being positioned on said boss.

5. The mechanism according to claim 4, further comprising a finger projecting from said trigger, said finger engaging said second surface on said boss when said body is in said second position and thereby preventing motion of said trigger.

6. The mechanism according to claim 4, further comprising a notch positioned in said hammer, said notch being aligned with said boss when said body is not in said second position and thereby permitting motion of said hammer to discharge said firearm, said notch being out of alignment with said boss when said body is in said second position, said hammer thereby being engageable with said second surface of said boss to prevent discharge of said firearm.

7. A repeating firearm comprising:

a receiver;

a barrel mounted on said receiver;

a bolt carrier mounted on said receiver and movable between an open position and a closed position wherein said bolt carrier engages a chamber of said barrel;

a hammer movably mounted substantially within said receiver;

a trigger movably mounted substantially within said receiver;

a body movably mounted substantially within said receiver, said body having a first and a second surface thereon, said body being movable between a first position wherein said first surface engages and holds said bolt carrier in said open position, and a second position wherein said first surface does not engage said bolt carrier, said second surface being engageable with said trigger when said body is in said second position so as to prevent motion of said trigger and thereby a discharge of said firearm; and a spring acting between said receiver and said body for biasing said body into said first position.

8. The firearm according to claim 7, further comprising a pin mounted on said receiver, said body being mounted on said pin for pivoting movement between said first and said second positions.

9. The firearm according to claim 8, wherein said pin is mounted on an outside surface of said receiver.

10. The firearm according to claim 8, further comprising a tab attached to said body in spaced relation to said pin and extending outside of said receiver for manually moving said body between said first and said second positions.

11. The firearm according to claim 7, further comprising a boss positioned on said body and projecting transversely therefrom, said second surface being positioned on said boss.

12. The firearm according to claim 11, further comprising a finger projecting from said trigger, said finger engaging said second surface on said boss when said body is in said second position and thereby preventing motion of said trigger.

13. The firearm according to claim 11, further comprising a notch positioned in said hammer, said notch being aligned with said boss when said body is not in said second position and thereby permitting motion of said hammer to discharge said firearm, said notch being out of alignment with said boss when said body is in said second position, said hammer thereby being engageable with said second surface of said boss to prevent discharge of said firearm.

14. The firearm according to claim 7, further comprising a magazine well positioned within said receiver.

15. The firearm according to claim 14, further comprising an ammunition magazine removably positionable within said magazine well.

16. The firearm according to claim 7, wherein said firearm comprises a rifle.

17. A repeating firearm comprising:

a receiver;

a barrel mounted on said receiver;

a bolt carrier mounted on said receiver and movable between an open position and a closed position wherein said bolt carrier engages a chamber of said barrel;

a hammer movably mounted substantially within said receiver;

a trigger movably mounted substantially within said receiver;

a body movably mounted substantially within said receiver, said body having a first and a second surface thereon, said body being movable between a first position wherein said first surface engages and holds said bolt carrier in said open position, and a second position wherein said first surface does not engage said bolt carrier, said second surface being engageable with said hammer when said body is in said second position so as to inhibit motion of said hammer and thereby prevent a discharge of said firearm; and a spring acting between said receiver and said body for biasing said body into said first position.

18. The firearm according to claim 17, further comprising a pin mounted on said receiver, said body being mounted on said pin for pivoting movement between said first and said second positions.

19. The firearm according to claim 18, wherein said pin is mounted on an outside surface of said receiver.

20. The firearm according to claim 18, further comprising a tab attached to said body in spaced relation to said pin and extending outside of said receiver for manually moving said body between said first and said second positions.

21. The firearm according to claim 17, further comprising a boss positioned on said body and projecting transversely therefrom, said second surface being positioned on said boss.

22. The firearm according to claim 21, further comprising a notch positioned in said hammer, said notch being aligned with said boss when said body is not in said second position and thereby permitting motion of said hammer to discharge said firearm, said notch being out of alignment with said boss when said body is in said second position, said hammer thereby being engageable with said second surface of said boss to prevent discharge of said firearm.

23. The firearm according to claim 17, further comprising a magazine well positioned within said receiver.

24. The firearm according to claim 23, further comprising an ammunition magazine removably positionable within said magazine well.

25. The firearm according to claim 17, wherein said firearm comprises a rifle.

* * * * *